US009763853B2

(12) United States Patent
Miceli et al.

(10) Patent No.: US 9,763,853 B2
(45) Date of Patent: Sep. 19, 2017

(54) CLOSURE LOCKING ASSEMBLY

(71) Applicant: Tri State Distribution, Inc., Sparta, TN (US)

(72) Inventors: David A. Miceli, Reno, NV (US); Joseph A. Miceli, Spencer, TN (US)

(73) Assignee: Tri State Distribution, Inc., Sparta, TN (US)

( * ) Notice: Subject to any disclaimer, the term of this patent is extended or adjusted under 35 U.S.C. 154(b) by 0 days.

(21) Appl. No.: 14/856,832

(22) Filed: Sep. 17, 2015

(65) Prior Publication Data

US 2016/0074280 A1 Mar. 17, 2016

Related U.S. Application Data

(60) Provisional application No. 62/051,378, filed on Sep. 17, 2014.

(51) Int. Cl.

| | |
|---|---|
| ***B65D 50/04*** | (2006.01) |
| ***A61J 1/03*** | (2006.01) |
| ***B65D 45/00*** | (2006.01) |
| ***B65D 45/16*** | (2006.01) |
| ***B65D 45/32*** | (2006.01) |
| ***A61J 1/14*** | (2006.01) |

(52) U.S. Cl.

CPC ..... *A61J 1/03* (2013.01); *A61J 1/1412* (2013.01); *B65D 45/00* (2013.01); *B65D 45/16* (2013.01); *B65D 45/32* (2013.01); *B65D 50/046* (2013.01); *B65D 2215/02* (2013.01)

(58) Field of Classification Search

CPC ..... A61J 1/03; A61J 1/1412; B65D 50/046; B65D 2215/02; B65D 45/00; B65D 45/16; B65D 45/18; B65D 45/322; B65D 45/24; B65D 45/32

USPC ..... 215/277, 224, 225, 216, 280, 274; 220/315, 324, 326, 787–789, 314; 292/256, 256.5, DIG. 11

See application file for complete search history.

(56) References Cited

U.S. PATENT DOCUMENTS 854,845 A 5/1907 Robinson
896,304 A * 8/1908 Larkin ..... B65D 51/243 215/305

(Continued)

OTHER PUBLICATIONS

Medlock—YouTube Screen Shots, https://www.youtube.com/watch?v=c5R9nEYBTVM.

*Primary Examiner* — James N Smalley

(74) *Attorney, Agent, or Firm* — Luedeka Neely Group, PC

(57) ABSTRACT

A locking assembly for a closure system having a first vertical member configured to extend downward along a sidewall of a closure and including a first hook element and a second hook element. A second vertical member having a first hook element and a second hook element is configured to be connected to the first vertical member such that the second vertical member extends downward along an opposite side of the sidewall of the closure from the first vertical member. When the locking assembly is installed on the closure system in a locked position, the first and second vertical members are dimensioned and configured so that the first hook elements are disposed above opposing sides of a top surface of the closure and the second hook elements are disposed beneath opposing sides of the sidewall of the closure for preventing the closure from being removed from the container.

23 Claims, 15 Drawing Sheets

(56) References Cited

U.S. PATENT DOCUMENTS

| | | | | | |
|---|---|---|---|---|---|
| 1,083,482 | A | | 1/1914 | Bray | |
| 1,996,411 | A | * | 4/1935 | Elliott | B65D 45/24 215/280 |
| 4,203,524 | A | | 5/1980 | Wieland | |
| 4,271,972 | A | * | 6/1981 | Thor | B65D 55/02 215/251 |
| 4,405,161 | A | * | 9/1983 | Young | E21B 33/03 137/382 |
| 4,480,762 | A | * | 11/1984 | Thomas | B65D 50/045 215/216 |
| 4,768,264 | A | * | 9/1988 | Kunna | A47J 36/06 24/522 |
| 4,801,033 | A | * | 1/1989 | Kanner | B65D 39/0023 215/277 |
| 4,854,459 | A | | 8/1989 | DeJonge | |
| 5,509,550 | A | | 4/1996 | DeJonge | |
| 5,975,322 | A | | 11/1999 | Reid | |
| 6,059,132 | A | | 5/2000 | Benjamin | |
| 7,252,204 | B1 | | 8/2007 | Small | |
| 7,798,348 | B2 | | 9/2010 | Sawyer | |
| 7,804,405 | B2 | * | 9/2010 | Norman | B65D 51/18 215/201 |

* cited by examiner

CLOSURE LOCKING ASSEMBLY

CROSS-REFERENCE TO RELATED APPLICATION

This application claims priority to U.S. Provisional Application Ser. No. 62/051,378 filed Sep. 17, 2014, entitled "Closure Locking Assembly," the entire contents of which is incorporated herein in its entirety.

FIELD

This disclosure relates to a closure locking assembly. More particularly, this disclosure relates to a closure locking assembly for pharmaceutical containers that prevents a user from removing a closure with respect to a container.

BACKGROUND

Many child-resistant closure systems, or reversible child resistant closure systems in the child resistant configuration, require a user to push-down-and-turn the closure with respect to a container to remove the closure from the container. For example, U.S. Pat. No. 5,499,078 describes a push-down-and-turn container system having a container with a plurality of locking lug receivers on the outer circumference of the neck/rim of the container and a closure having a circumferential sidewall with corresponding locking lugs along the inner surface of the sidewall. To install the closure to the container, the locking lug receivers 10 each include a tapered ramp 12 as shown in FIG. 1 herein that guides the locking lugs of the closure into a notch 14 of the locking lug receiver 10 upon rotation of the closure. As shown, the notch 14 is formed between the tapered ramp 12 and a vertical member 16 of the locking lug receiver 10. Engagement of the locking lugs with the corresponding locking lug receivers 10 prevents the closure from being turned in the counter-clockwise direction, and thus prevents the closure from being removed from the container 1.

In order to remove the closure from the container 1, the user must apply downward pressure to the closure to disengage corresponding locking lugs 9 (as best shown in FIG. 4) of the closure from the locking lug receivers 10 of the container 1, then turn the closure such that the locking lugs 9 are disposed in an open area 18 between adjacent locking lug receivers 10, and finally lift the closure from the container 1. Thus, these types of closure systems are commonly referred to as push-down-and-turn systems.

Similarly, as exemplified in U.S. Pat. No. 8,662,331, many child resistant closure systems include a deflectable locking structure disposed along a rim on the neck of the container for releasably engaging a locking lug of the closure. To remove this closure from the container, the user pushes down on the deflectable locking structure of to disengage the locking lug of the closure.

While these types of closure systems are generally effective in preventing a child from removing the closure from the container, it is not impossible for children to open the containers (hence the name "child resistant"). In particular, a child playing with the closure system may apply downward pressure to the closure resulting in disengagement of the locking lugs from the locking receivers. Once the locking lugs are disengaged, it is generally easy to intentionally or unintentionally remove the closure from the container. Also, the child may even figure out how to open the container, such as by watching their parents or even reading instructions on top of the closure, and then be able to do so on their own.

What is needed therefore is at least an option for the user to apply an enhanced locking system to the closure system.

SUMMARY

A closure locking assembly for a closure system includes a first vertical member and a second vertical member. The first vertical member is configured to extend downward along a sidewall of a closure and include a first hook element disposed adjacent a proximal end of the first vertical member and a second hook element disposed adjacent a distal end of the first vertical member. The second vertical member is configured to be connected to the first vertical member such that the second vertical member extends downward along an opposite side of the sidewall of the closure from the first vertical member, and the second vertical member includes a first hook element disposed adjacent a proximal end of the second vertical member and a second hook element disposed adjacent a distal end of the second vertical member. When the second vertical member is connected to the first vertical member and the locking assembly is installed on the closure system in a locked position, the first and second vertical members are dimensioned and configured so that the first hook elements of the first and second vertical members are disposed above opposing sides of a top surface of the closure, the second hook elements of the first and second vertical members are disposed beneath opposing sides of the sidewall of the closure, and a distal end of the second hook elements of the first and second vertical members are disposed adjacent opposing sides of a sidewall of a container for preventing the closure from being removed from the container.

According to certain embodiments where the container includes a plurality of locking receivers extending from the sidewall of the container, each of the second hook elements are dimensioned and configured to be disposed beneath at least one of the plurality of locking receivers when the locking assembly is installed on the closure system in the locked position. According to other embodiments where the container includes a rim extending from the sidewall of the container, each of the second hook elements are dimensioned and configured to be disposed beneath at least a portion of the rim when the locking assembly is installed on the closure system in the locked position.

According to certain embodiments, the first hook elements are connected to each other to form a horizontal member that traverses the top surface of the closure when the locking assembly is installed on the closure system in a locked position. In preferred embodiments, the horizontal member is operable to move between an unlocked position and the locked position.

According to some embodiments, a protrusion is disposed on an interior surface of each of the first vertical member and the second vertical member where the protrusions are configured to be inserted into corresponding indentions disposed in the sidewall of the closure to prevent axial movement of the closure when the locking assembly is installed on the closure assembly in the locked position.

According to certain embodiments, the first hook element of the first vertical member forms a male engaging member and the first hook element of the second vertical member forms a female engaging member, and the male engaging member is operable to releasably engage the female engaging member to connect the second vertical member to the first vertical member and move the locking assembly between an unlocked position and the locked position. According to some embodiments, the male engaging member and the female engaging member form a horizontal member that traverses the top surface of the closure when the male engaging member is engaged with the female engaging member; the male engaging member includes a locking tab operable to releasably engage a locking receiver of the female engaging member to secure the male engaging member to the female engaging member in the locked position; the locking tab and locking receiver are dimensioned and configured so that a user can disengage the locking tab from the locking receiver by deforming the locking tab; the female engaging member includes a passage leading to the locking receiver and the male engaging member is operable to slide within the passage of the female engaging member until the locking tab of the male engaging member engages the locking receiver of the female engaging member; the passage of the female engaging member includes an aperture disposed adjacent the locking receiver where the aperture is dimensioned and configured to require a key to be inserted through the aperture to deform the locking tab so that a user can disengage the locking tab from the locking receiver; the key includes indicium warning the user to store the key in a location away from the locking assembly; the locking receiver is an aperture disposed in a top surface of the passage and the male engaging member and corresponding locking tab are dimensioned and configured such that the locking tab at least partially protrudes from the aperture in the locked position; the locking tab includes at least one deflectable wing and the female engaging member includes at least one depressible sidewall having a protrusion disposed on an interior surface of the depressible sidewall adjacent the locking receiver such that the protrusion deforms the at least one deflectable wing via the depressible sidewall so that a user can disengage the locking tab from the locking receiver; and/or the female engaging member includes at least one depressible sidewall adjacent the locking receiver for deforming the locking tab so that a user can disengage the locking tab from the locking receiver.

According to another embodiment of the disclosure, a locking assembly includes a male part and a female part. The male part includes a male engaging member, a male vertical member extending downward from the male engaging member, and a first hook element disposed adjacent a distal end of the male vertical member. The female part includes a female engaging member dimensioned and configured to releasably engage the male engaging member when the locking assembly is in a locked position, a female vertical member extending downward from the female engaging member, and a second hook element disposed adjacent a distal end of the female vertical member. When the locking assembly is installed on the closure system in the locked position, the male and female engaging members form a horizontal member dimensioned and configured to traverse a top surface of a closure, the male and female vertical members are dimensioned and configured so that the first and second hook elements are disposed beneath opposing sides of a sidewall of the closure, and a distal end of the first and second hook elements are disposed adjacent opposing sides of a sidewall of a container for preventing the closure from being removed from the container.

According to certain embodiments, the male engaging member includes a locking tab and the female engaging member includes a locking receiver, the locking tab and corresponding locking receiver being dimensioned and configured so that a user can disengage the locking tab from the locking receiver by deforming the locking tab; the female engaging member includes a passage leading to the locking receiver and the male engaging member is operable to slide within the passage of the female engaging member until the locking tab engages the locking receiver; the passage of the female engaging member includes an aperture disposed adjacent the locking receiver that is dimensioned and configured to require a key to be inserted through the aperture to deform the locking tab so that a user can disengage the locking tab from the locking receiver; the locking receiver is an aperture disposed in a top surface of the passage and the male engaging member and corresponding locking tab are dimensioned and configured such that the locking tab at least partially protrudes from the aperture in the locked position; and/or the female engaging member includes at least one depressible sidewall adjacent the locking receiver for deforming the locking tab.

According to another embodiment of the disclosure, the locking assembly includes a horizontal member including a first end and a second end; a first vertical member extending downward from the first end of the horizontal member, the first vertical member including a first protrusion disposed on an interior surface of the first vertical member; and a second vertical member extending downward from the second end of the horizontal member, the second vertical member including a second protrusion disposed on an interior surface of the second vertical member. When the locking assembly is installed on the closure system in a locked position, the horizontal member is dimensioned and configured to traverse a top surface of a closure and the first and second vertical members are dimensioned and configured so that the first and second protrusions are operable to be inserted into corresponding indentions disposed in a sidewall of the closure for preventing axial movement of the closure.

According to certain embodiments, each of the first and second protrusions are dimensioned and configured to be disposed between two adjacent locking receivers of a container having a plurality of locking receivers extending from a sidewall of the container when the locking assembly is installed on the closure system in the locked position; the horizontal member is operable to expand between an unlocked position and the locked position; the locking assembly further includes a male part including the first vertical member and a male engaging member and a female part including the second vertical member and a female engaging member, the male engaging member operable to releasably engage the female engaging member to move the locking assembly between an unlocked position and the locked position; and/or the male engaging member and the female engaging member form the horizontal member when the male engaging member is engaged with the female engaging member.

According to yet another embodiment of the disclosure, the locking assembly includes a male part and a female part. The male part includes at least one male engaging member and a first hook element disposed adjacent a proximal end of the at least one male engaging member. The female part includes at least one female engaging member dimensioned and configured to releasably engage the at least one male engaging member when the locking assembly is in a locked position and a second hook element disposed adjacent a proximal end of the at least one female engaging member. When the locking assembly is installed on the closure system in the locked position, the at least one male and female engaging members form at least one vertical member dimensioned and configured to traverse opposing sidewalls of the closure system so that one of the first hook element and the second hook element is disposed beneath a bottom surface of a container and one of the first hook element and the second hook element is disposed above a top surface of a closure for preventing the closure from being removed from the container.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

The disclosure relates to a locking assembly for preventing undesired opening of a closure system, particularly by children. "Closure system" or "closure assembly" as used herein refers to a closure as installed on a container to close the container opening. The locking assembly of the present disclosure is primarily directed for use with closure systems intended to store and dispense pharmaceutical products, and particularly prescription pharmaceuticals. However, the locking assembly may also be used with other types of closure systems in which an enhanced child proof closure is desired such as closure systems for household cleaners, solvents, vitamins, etc.

Figure 2:
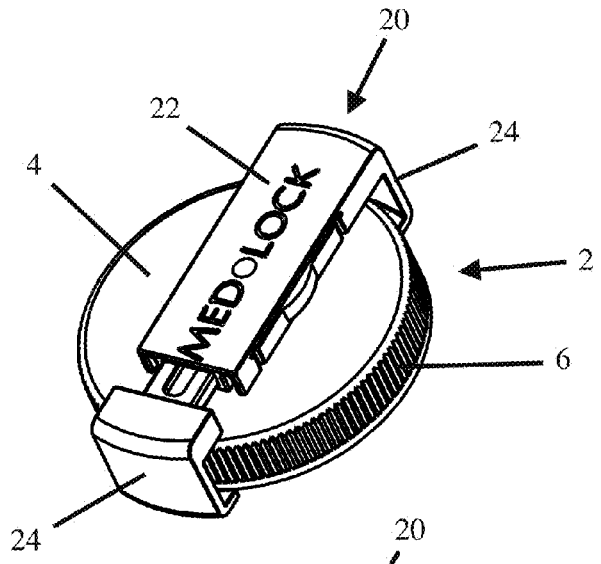
FIG. 2 is an overhead perspective view of a locking assembly positioned on a closure in an unlocked position according to one embodiment of the disclosure.
Figure 3:
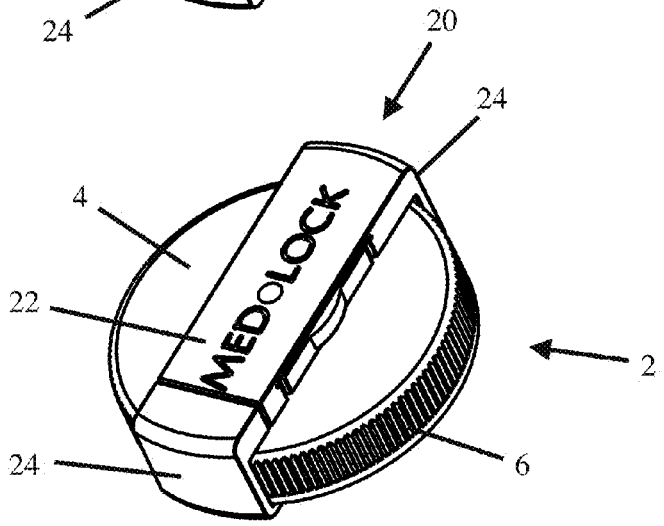
FIG. 3 is an overhead perspective view of the locking assembly of FIG. 2 positioned on the closure in a locked position according to one embodiment of the disclosure.
Figure 4:
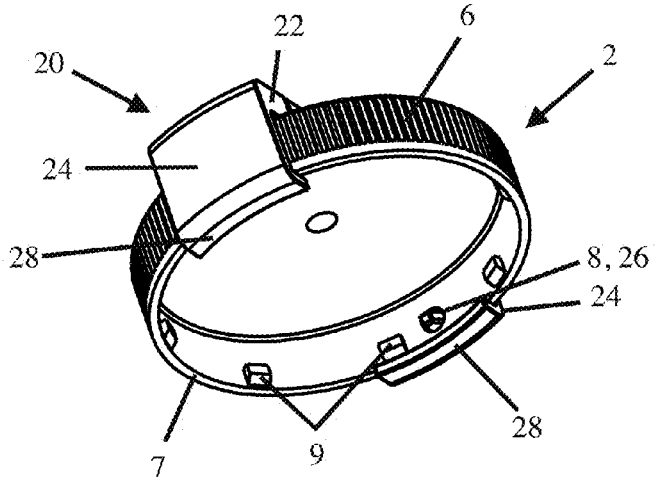
FIG. 4 is a bottom perspective view of the locking assembly of FIGS. 2-3 positioned on the closure in the locked position according to one embodiment of the disclosure.

One embodiment of the child proof locking assembly 20 of the present disclosure is exemplified in FIGS. 2-9. Referring to FIGS. 2-4, the locking assembly 20 is preferably operable to be secured across the top surface 4 and around the circumferential sidewall 6 of a closure 2. In order to install or remove the locking assembly 20 from a closure system, the locking assembly 20 is adjustable between an unlocked/expanded position (FIG. 2) and a locked position (FIGS. 3-4). While in the locked position, the locking assembly 20 is dimensioned and configured to tightly grip the top surface 4 and underneath opposing sides of the sidewall 6 of the closure 2. In this regard, the locking assembly 20 in the locked position generally includes a horizontal member 22 traversing the top surface 4 of closure 2 and two vertical members 24 extending downward from opposite ends of the horizontal member 22 and abutting opposing sides of sidewall 6 of closure 2. In order to tightly grip opposing sides of the sidewall 6, the vertical members 24 are preferably rounded to conform to the circumferential sidewall 6 of the closure 2 and container 1. As shown in FIG. 2, the horizontal member 22 is preferably operable to expand lengthwise to achieve the unlocked position to remove the locking assembly 20 from a closure system. However, it should be understood that the locking assembly 20 may be removed from a closure system in other manners such as one or both of the vertical members 24 being operable to expand away or be removed from the horizontal member 22.

Referring to FIG. 4, the vertical members 24 each include a hooking element 28 that extends from a distal end of the vertical member 24 in a horizontal direction substantially parallel to the horizontal member 22. Accordingly, hooking elements 28 are disposed beneath a bottom edge 7 of opposing sides of the sidewall 6 of closure 2 in the locked position. In preferred embodiments, as shown in the cross sectional view of FIG. 5A where the locking assembly 20 is installed on a closure system in the locked position, hooking elements 28 are dimensioned and configured such that they extend from their respective vertical members 24 until the distal end of the hooking elements 28 abut the container sidewall 19 in order to prevent outward deflection of the vertical members 24 and/or prying open of the locking assembly 20 by an unintended user when the locking assembly 20 is in the locked position on a closure assembly.

Figure 1:
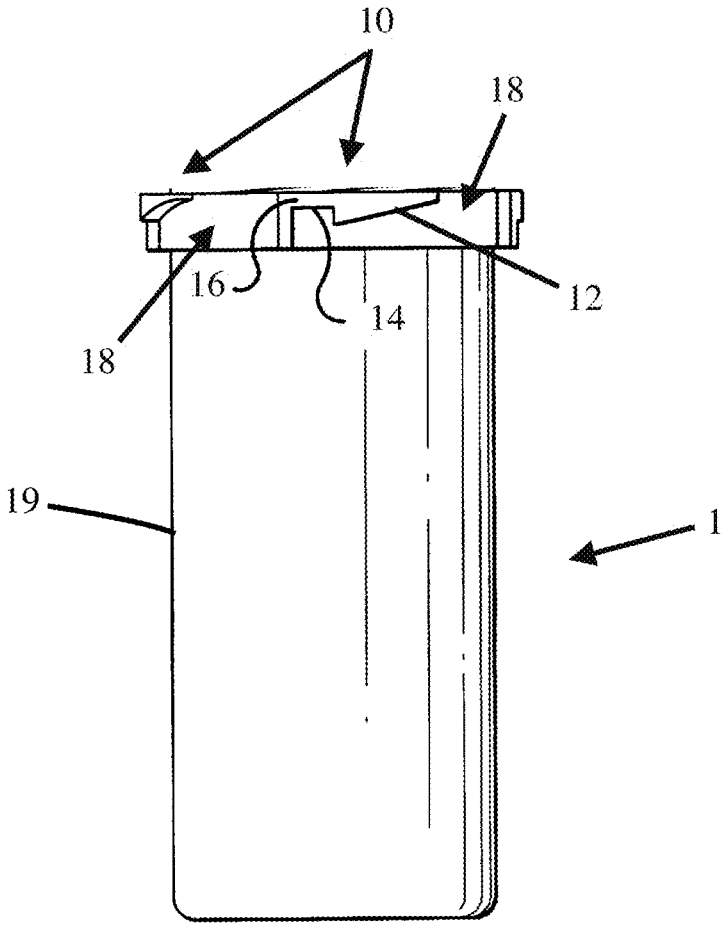
FIG. 1 PRIOR ART
FIG. 1 is a side view of an exemplary prior art container having locking lug receivers disposed on the outer circumference of the container.

When the locking assembly 20 is positioned on a closure assembly in the locked position, the hooking elements 28 prevent the closure 2 from being removed from the container 1 by "hooking" underneath portions of a container that extend radially outward from the container sidewall 19. For example, referring to a closure system such as U.S. Pat, No. 5,499,078 described above having a plurality of locking receivers 10 extending from the neck of the container 1 as shown in FIG. 1, the hooking elements 28 prevent the closure 2 from being raised with respect to the container 1 by being wide enough such that at least a portion of each hooking element 28 is always disposed underneath at least a portion of at least one locking receiver 10. As another example, when the container includes a rim extending from the sidewall of the container as exemplified in U.S. Pat. No. 8,662,331, the hooking elements 28 prevent the closure from being raised with respect to the container due to the hooking elements 28 being disposed underneath the container rim in the locked position. Accordingly, when a user attempts to open a closure system with a locking assembly 20 secured thereto in the locked position, the hooking elements 28 are configured to contact the locking receivers 10, a rim, or any other portion of the container that extends from the container sidewall 19 to prevent the user from removing the locking assembly and/or raising the closure with respect to the container.

Figure 5:
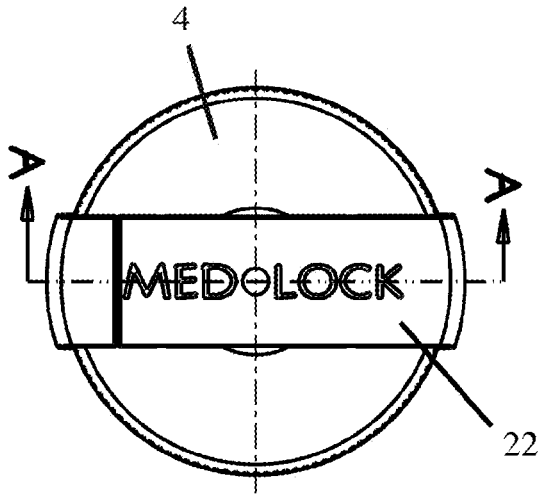
FIG. 5 is a top view of the locking assembly of FIGS. 2-4 positioned on a closure system in the locked position according to one embodiment of the disclosure.
Figure 5A:
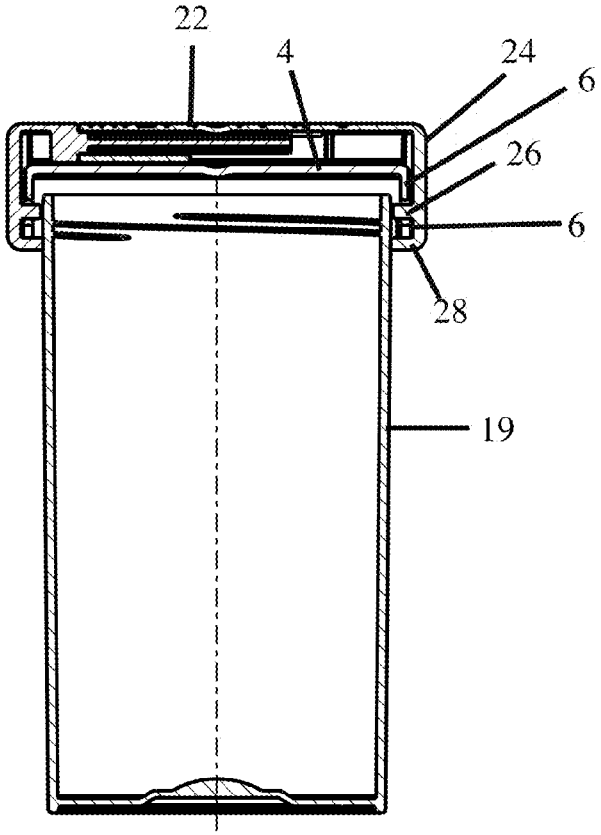
FIG. 5A is a cross-sectional view of the locking assembly of FIG. 5.
Figure 6:
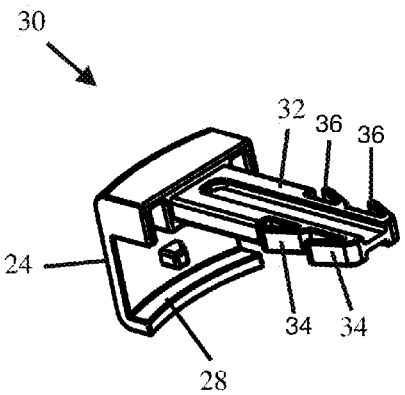
FIG. 6 is a top perspective view of a male part of the locking assembly of FIGS. 2-5.
Figure 7:
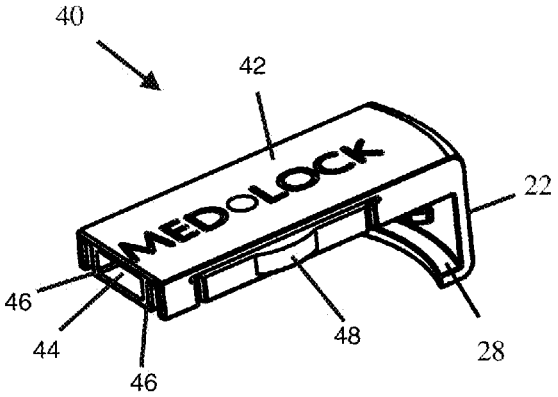
FIG. 7 is a top perspective view of a female part configured to receive the male part of FIG. 6.
Figure 8:
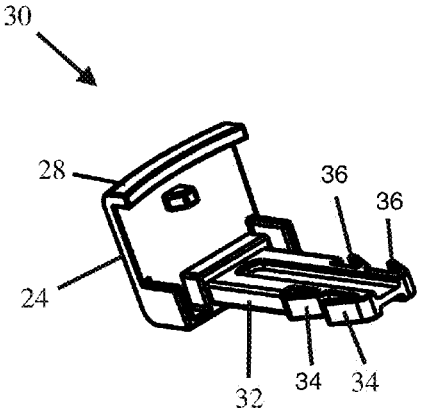
FIG. 8 is a bottom perspective view of the male part of FIG. 6.
Figure 9:
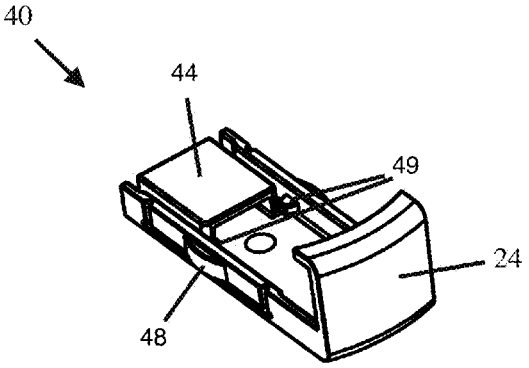
FIG. 9 is a bottom perspective view of the female part of FIG. 7.

Referring to FIG. 4 and FIG. 5A, to assist in securing the locking assembly 20 to the closure 2 in a tight gripping position, the closure 2 may also include indentions 8 that receive tab protrusions 26 extending from the interior surface of the vertical members 24. It should be understood that the indentions may take various forms including notches, slots, apertures, etc. In embodiments where the closure 2 includes a plurality of locking lugs 26 for engaging a plurality of locking receivers 10 of the container as described in U.S. Pat. No. 5,499,078, the indentions 8 are preferably apertures and the corresponding protrusions 26 are preferably positioned such that the protrusions 26 extend into the space 18 between adjacent locking lug receivers 10 when the closure 2 is correctly installed on the container 1 in the child resistant position. On the other hand, when the closure 2 is not properly installed on the container 1, the locking lug receivers 10 will interfere with the protrusions 26 because the protrusions 26 would contact a portion of a locking receiver that surrounds the notch 14 instead of extending into the space 18 between adjacent locking receivers. In other words, the position/configuration of the indentions 8 and protrusions 26 preferably prevent the locking assembly 20 from moving to the locked position unless the closure 2 is installed on the container 1 in the correct child resistant position where the locking lugs 9 of the closure 2 are disposed in the notches 14 of the locking receivers 10 of the container 1.

According to embodiments of locking assembly with the protrusions 26, the protrusions also operate to prevent the user from being able to rotate the closure 14 because the protrusions 26 extending into spaces 18 between locking receivers 10 will abut the vertical member 16 of a locking receiver when the closure 2 is rotated, which prevents the locking lugs 26 from being able to disengage from notches 14. It is noted that because both the hooking elements 28 and the protrusions 26 prevent removal of the closure 2 from the container 1, certain embodiments of the disclosure may include protrusions 26 without hooking elements 28 and other embodiments may include hooking elements 28 without protrusions 26.

Referring to FIGS. 6-9, the locking assembly 20 includes a male part 30 and a female part 40 operable to be joined in a sliding tongue-and-groove type connection. In this regard, the male part 30 includes a male engaging member 32 and one of the vertical members 24 with its corresponding hook element 28. The female part 40 includes the other vertical member 24 with its corresponding hook element 28 and a female engaging member 42 dimensioned and configured to interact with the corresponding male engaging member 32 to removably secure the male part 30 to the female part 40 in the locked position. When joined, the male engaging member 32 and female engaging member 42 form the horizontal member 22.

In preferred embodiments, the male part 30 and female part 40 include corresponding components of a positioning assembly for moving the locking assembly 20 between the locked position and the unlocked position. According to the embodiment of FIGS. 6-9, the male engaging member 32 includes a locking tab 34 in the form of at least one set of deflectable wings, and the female engaging member 42 includes a corresponding locking receiver 44 in the form of a passage dimensioned and configured to receive the deflectable wings in their deflected position. To connect the male part 30 to the female part 40, the male engaging member 32 is inserted through the passage 44 until the deflected wings 34 are positioned past the passage 44. Once the wings 34 move past the backend of the passage 34, the wings 34 move to their undeflected position such that the rear ends 36 of one of the sets of wings 34 abut the sidewalls 46 of the passage 44 when a user attempts to extend the locking assembly without deflecting the wings 34, which prevents movement of the locking assembly 20 from the locked position to the unlocked position.

In order to move the locking assembly from the locked position to the unlocked position, the female engaging member 42 includes depressible sidewalls 48 adjacent to the female receiver 44 each having a protrusion 49 disposed on the interior surface of the respective sidewall 48. Thus, when the sidewalls 48 of the female engaging member 42 are pushed together, the protrusions 49 are operable to deflect the deflectable wings 34 of the male engaging member to allow the rear ends 36 of the wings 34 to be deflected and operable to move back through the passage 44. As shown, the male engaging member 32 preferably includes two sets of deflectable wings such that deflection of the first set of wings permits the locking assembly 20 to be moved from its locked position to an unlocked position while the second set of wings prevents the complete removal of the male part 30 from the female part 40.

While the width/circumference of the horizontal member 22 and vertical members 24 are shown in FIGS. 2-9 as being the same, it should be noted that the particular dimensions may vary as desired so long as the locking assembly 20, at least in the locked position, includes a horizontal member that stretches across the top surface of the closure and two vertical members to hook underneath opposing sides of the closure system. In preferred embodiments such as those shown in FIGS. 10-25 described below, the circumference of the vertical members 24 is increased with respect to the horizontal member to make it more difficult to remove the locking assembly 20 from a closure system. In this regard, increasing the circumference of the vertical members makes it not only more difficult to be able to lift the locking assembly 20 in the locked position off a closure system, but it also makes it more difficult slide the locking assembly 20 laterally with respect to the closure system. On the other hand, the desired circumference of the vertical members 24 should take into consideration of the fact that, the greater the circumference of the vertical members 24 (and horizontal member 22), the more resin will be needed to produce the locking assemblies 20.

Figure 10:
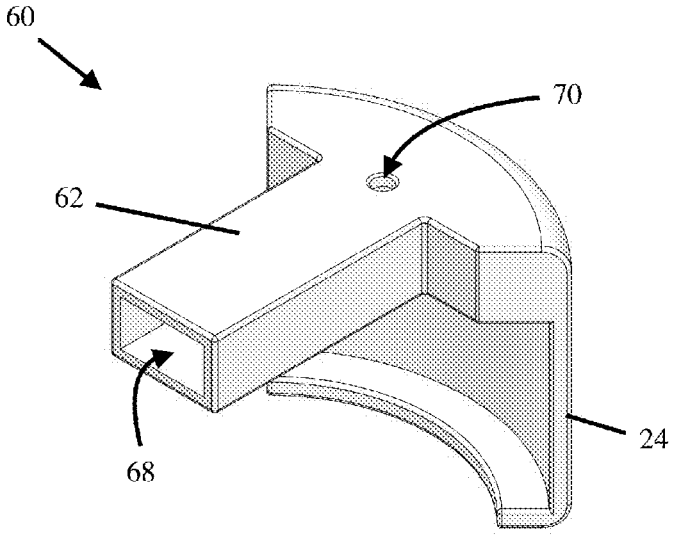
FIG. 10 is a top perspective view of a female part of a locking assembly according to another embodiment of the disclosure.
Figure 11:
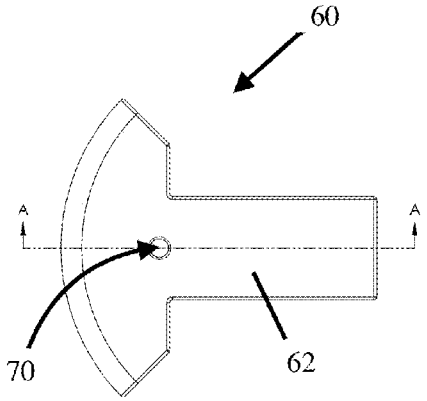
FIG. 11 is a top view of the female part of FIG. 10.
Figure 11A:
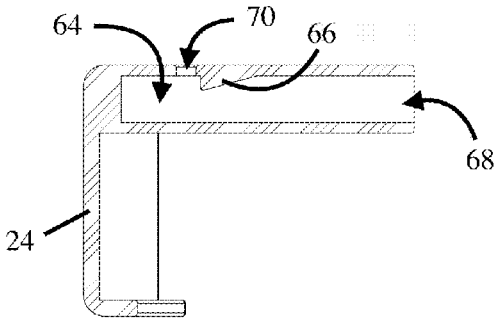
FIG. 11A is a cross-sectional view of the female part of FIG. 11.
Figure 12:
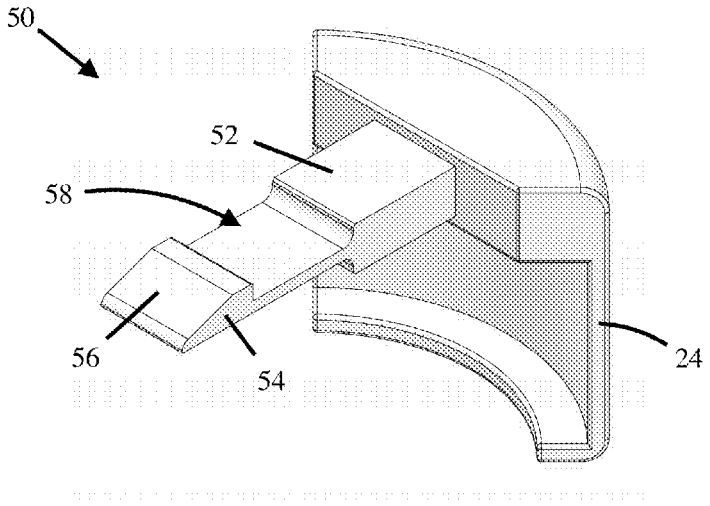
FIG. 12 is a top perspective view of a male part configured to engage the female part of FIGS. 10-11.
Figure 13:
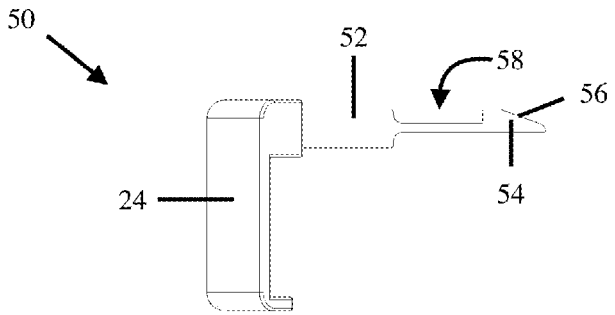
FIG. 13 is a side perspective view of the male part of FIG. 12.
Figure 14:
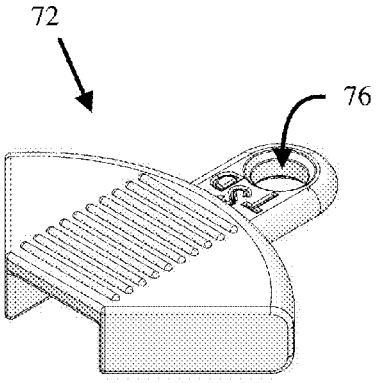
FIG. 14 is a top perspective view of a key for disengaging the male part of FIGS. 12-13 from the female part of FIGS. 10-11 according to one embodiment of the disclosure.
Figure 15:
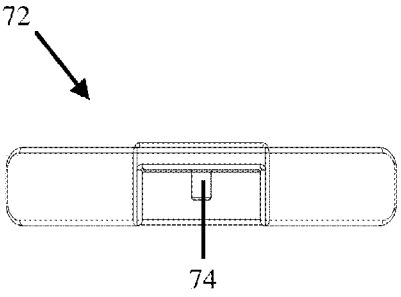
FIG. 15 is a front view of the key of FIG. 14.
Figure 16:
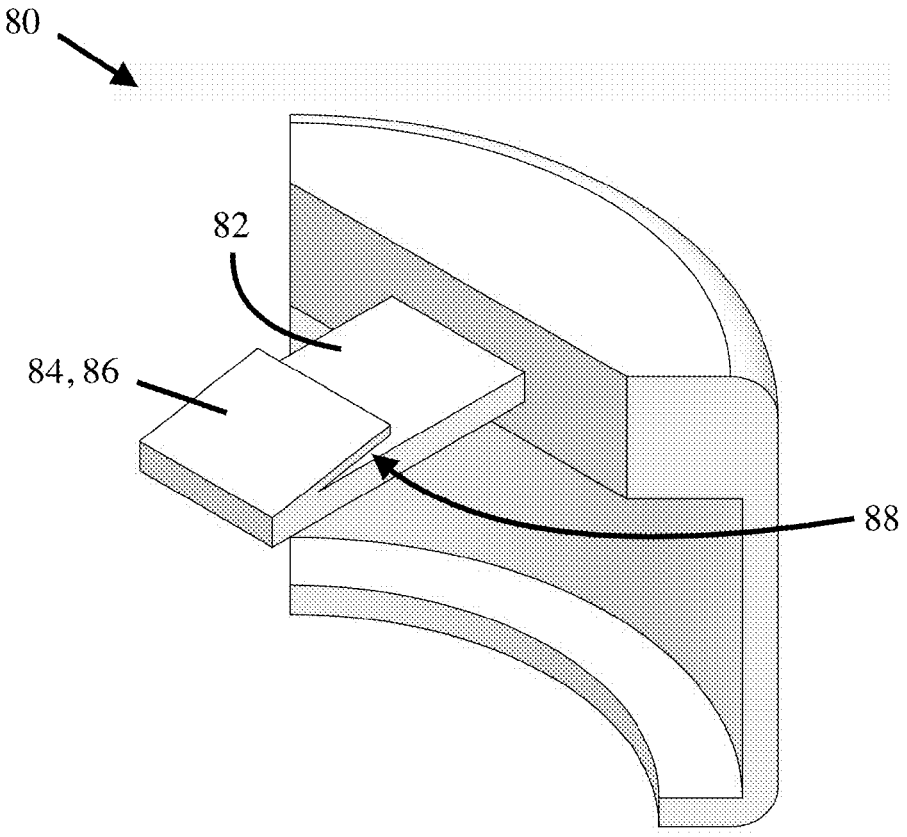
FIG. 16 is a top perspective view of a male part of a locking assembly according to another embodiment of the disclosure.
Figure 17:
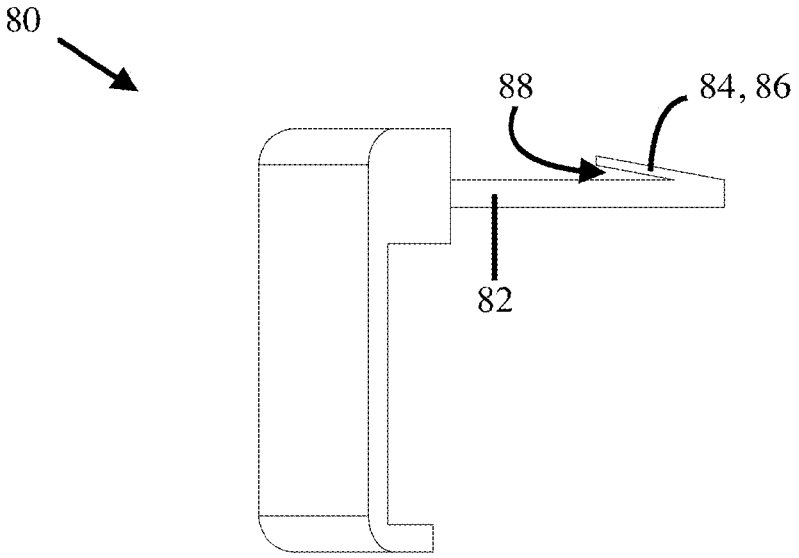
FIG. 17 is a side perspective view of the male part of FIG. 16.
Figure 18:
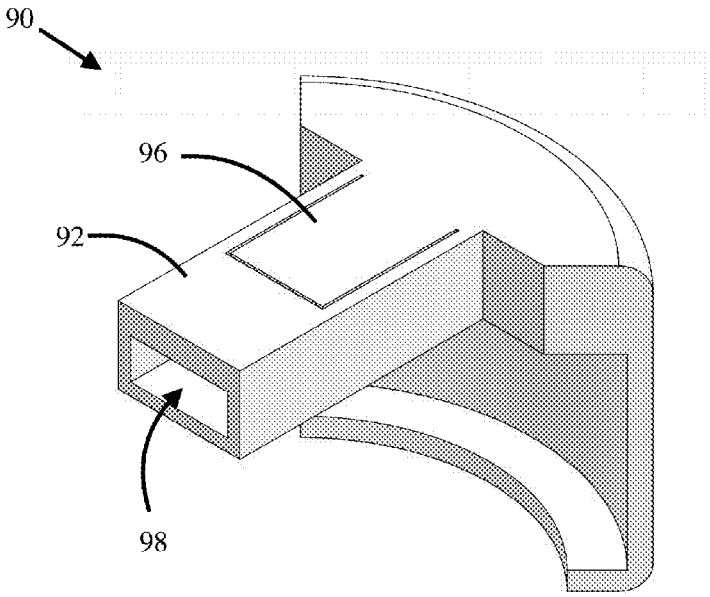
FIG. 18 is a top perspective view of a female part configured to receive the male part of FIGS. 16-17.
Figure 19:
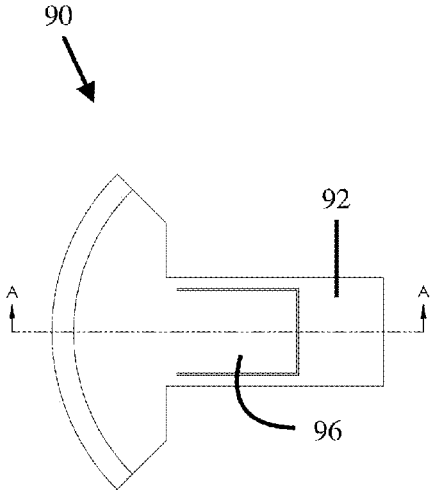
FIG. 19 is a top view of the female part of FIG. 18.
Figure 19A:
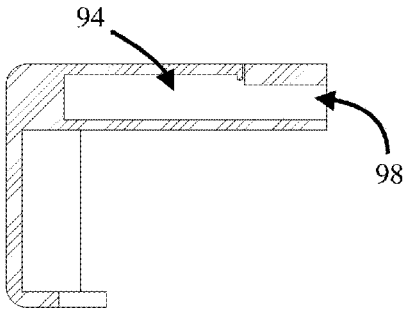
FIG. 19A is a cross-sectional view of the female part of FIG. 19.
Figure 20:
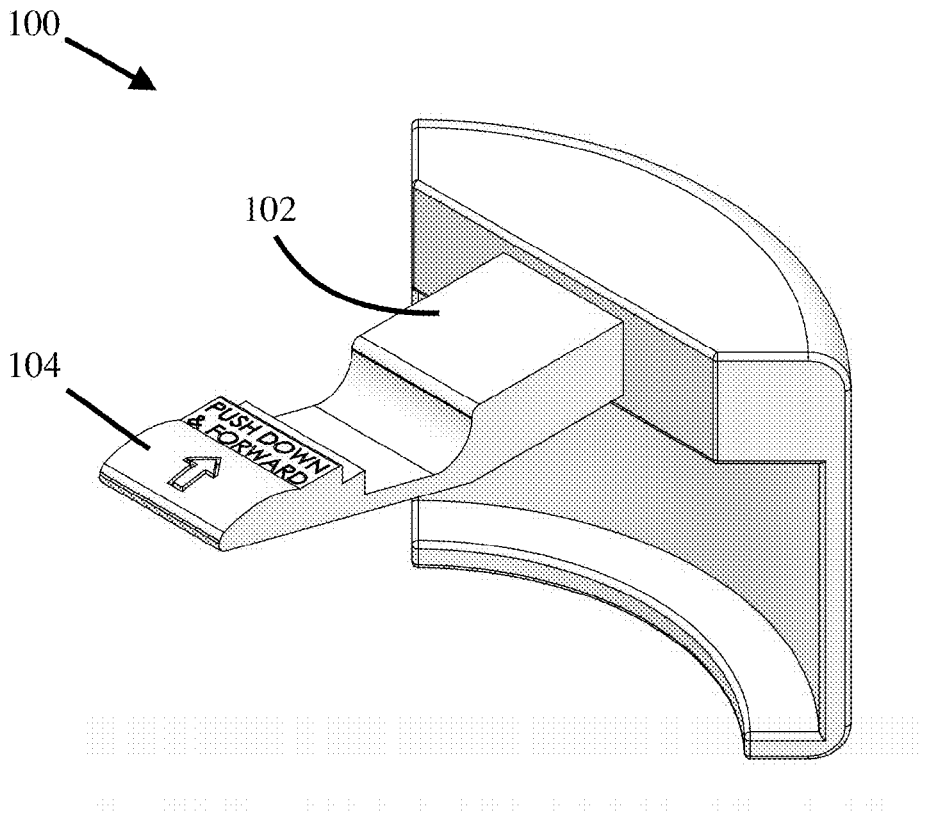
FIG. 20 is a top perspective view of a male part of a locking assembly according to another embodiment of the disclosure.

Referring to FIGS. 10-15, another embodiment of locking assembly 20 is depicted having male part 50 (FIGS. 12-13) and female part 60 (FIGS. 10-11). Similar to the embodiment of FIGS. 1-9, male part 50 includes a vertical member 24 and a male engaging member 52 having a deflectable locking tab 54, and the female part 60 includes vertical member 24 and a female engaging member 62 having a locking receiver 64. However, instead of a set of deflectable wings, the locking tab 54 of this embodiment includes a ramp surface 56 leading to a recess 58 disposed in the top surface of the male engaging member 52. As shown in the cross-sectional view of FIG. 11A, the female engaging member 62 includes a corresponding locking lug 66 secured to top surface of passage 68 leading to the locking receiver 64. In operation, the male engaging member 52 is inserted into passage 68 of the female engaging member 62 until the locking tab 54 traverses the locking lug 66, which secures the locking tab 54 to the locking receiver 64 via the locking lug 66 of the female engaging member being inserted into the recess 58 of the male engaging member 52.

According to this embodiment, the female engaging member 62 further includes an aperture 70 disposed in the top surface of passage 68 adjacent to the locking receiver 64 such that a user is able to deflect the locking tab 54 through the aperture 70 to disengage the locking tab 54 from the locking receiver 64. In certain embodiments where additional security is desired, the aperture 70 may be sized and dimensioned such that a foreign object is required to be inserted into the aperture 70 as opposed to a user's own finger. For example, the aperture 70 may be sufficiently small as shown, which requires the user to use a key 72 having a small protrusion 74 configured to fit into aperture 70 to deflect the locking tab 54. Further, the small size of aperture 70 operates to hide locking tab 54 and locking receiver 64, which makes the manner in which the locking assembly 20 is to be unlocked not easily discernible, especially to young children. As shown, the key 72 preferably includes a key ring 76 such that a user can secure the key to the user's key chain for safe keeping and to easily locate the key 72 when needed. Also, the key 72 preferably includes a recess that houses the protrusion 74 and is sized to closely fit around the top surface of the female part 60. By placing the protrusion 74 in such a recess as shown, the protrusion 74 is protected from being broken off the key 72 and the key 72 provides a self-aligning feature in which the protrusion 74 is inserted into the aperture 70 by positioning the key 72 and associated recess in the correct position over the female part 60.

In preferred embodiments, the key 72 includes indicium instructing the user to keep the key 72 in a location separate from closure assemblies secured with the locking assembly 20 and/or warning the user to not let their children see the user open a closure assembly with the key 72. In certain embodiments, the indicium is molded directly on the key. In other embodiments, the indicium may be provided on a sticker that is adhesively applied to the key 72.

Referring to FIGS. 16-19, another embodiment of locking assembly 20 is provided. According to this embodiment, the locking tab 84 of male part 80 is a single deflectable wing formed by providing spacing 88 between a ramp surface 86 and the male engaging member 82. Upon insertion of the deflectable wing 84 into passage 98 of female part 90, the ramp surface 86 is deflected downward until the deflectable wing 84 engages locking receiver 94. According to this embodiment, the female engaging member 92 includes a depressible top wall portion 96 adjacent the locking receiver 94 such that a user can press down on the top wall portion 96 to disengage the deflectable wing 84 from the locking receiver 94.

Figure 21:
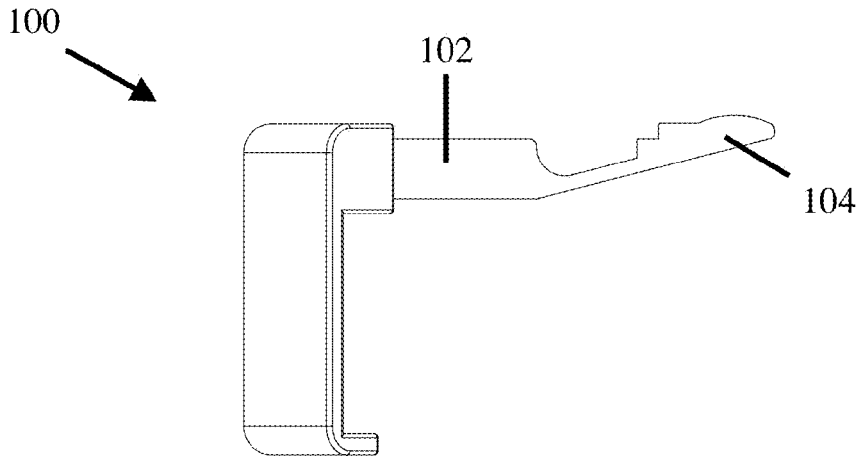
FIG. 21 is a side perspective view of the male part of FIG. 20.
Figure 22:
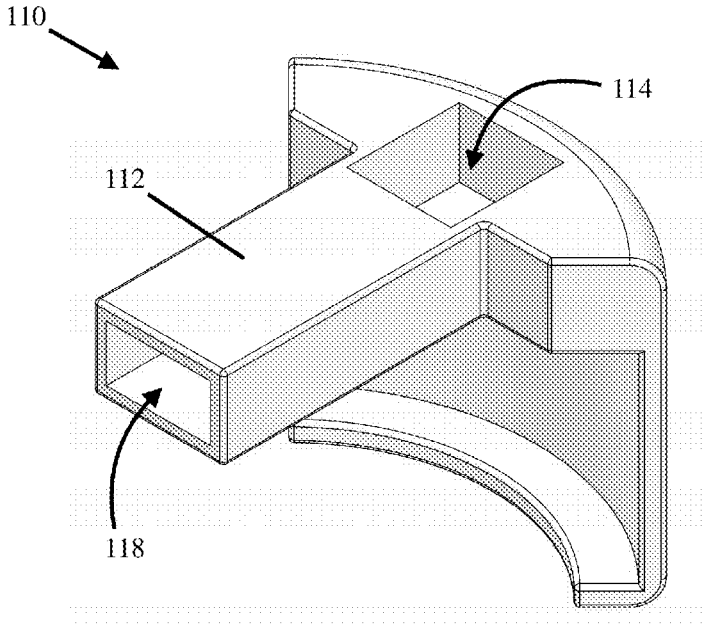
FIG. 22 is a top perspective view of a female part configured to receive the male part of FIGS. 20-21.
Figure 23:
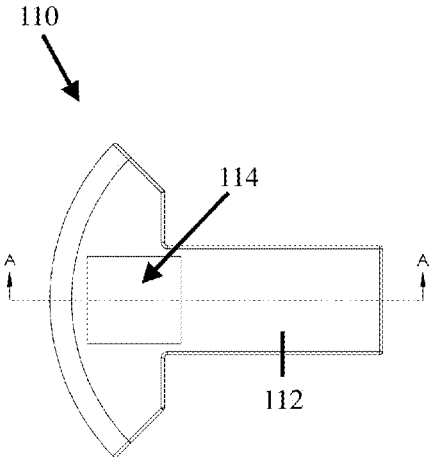
FIG. 23 is a top view of the female part of FIG. 22.
Figure 23A:
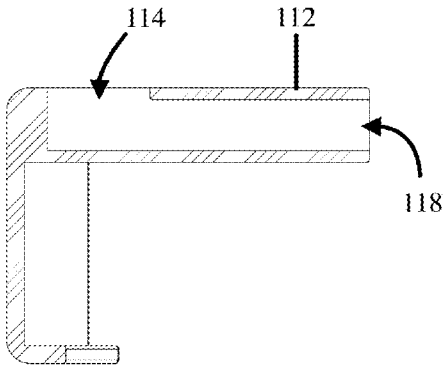
FIG. 23A is a cross-sectional view of the female part of FIG. 23.

Referring to FIGS. 20-23, yet another embodiment of locking assembly 20 is provided. According to this embodiment, male part 100 includes a deflectable locking tab 104 that is positioned slightly above the male engaging member 102 axis in its undeformed position as best shown in FIG. 21. The locking receiver 114 of female part 110 is provided as an aperture disposed in a top surface of the female engaging member 112. In operation, the locking tab 104 is deformed when it is inserted into passage 118 until it reaches locking receiver 114, where it returns to its undeformed position and engages the locking receiver 114 to secure the locking assembly 20 in the locked position. In order to disengage the locking tab 104 from the locking receiver 114, a user manually presses down on the locking tab 104 through the aperture. Thus, this embodiment is similar to the embodiment of FIGS. 10-15 except the aperture 70 of female part 60 has been increased in size and the male engaging member 52 has been configured such that the locking tab 54 engages the aperture 70 in the locked position to allow a user to press down on the locking tab 54 without requiring a key.

Figure 24:
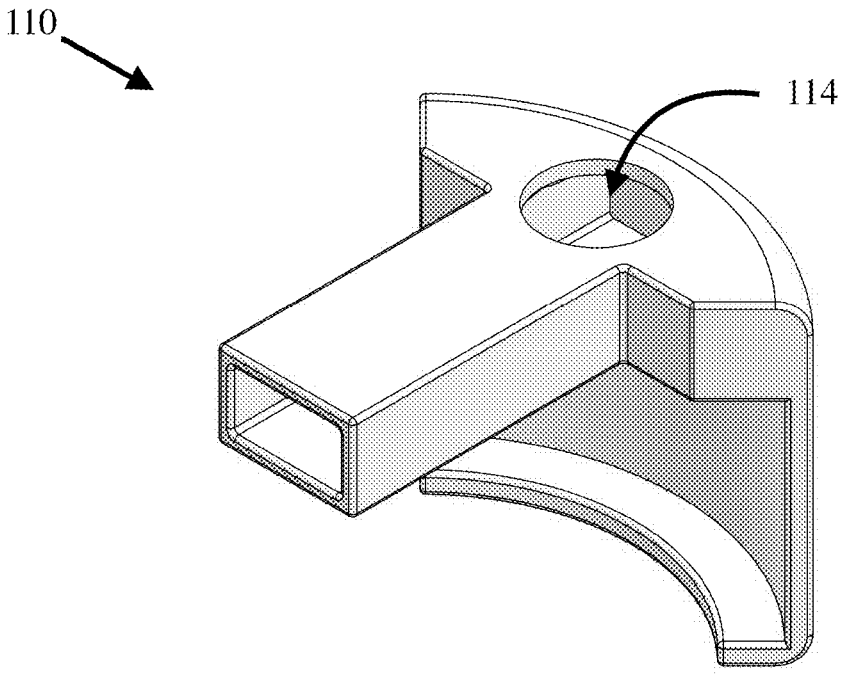
FIG. 24 is a top perspective view of a female part of a locking assembly according to another embodiment of the disclosure.
Figure 25:
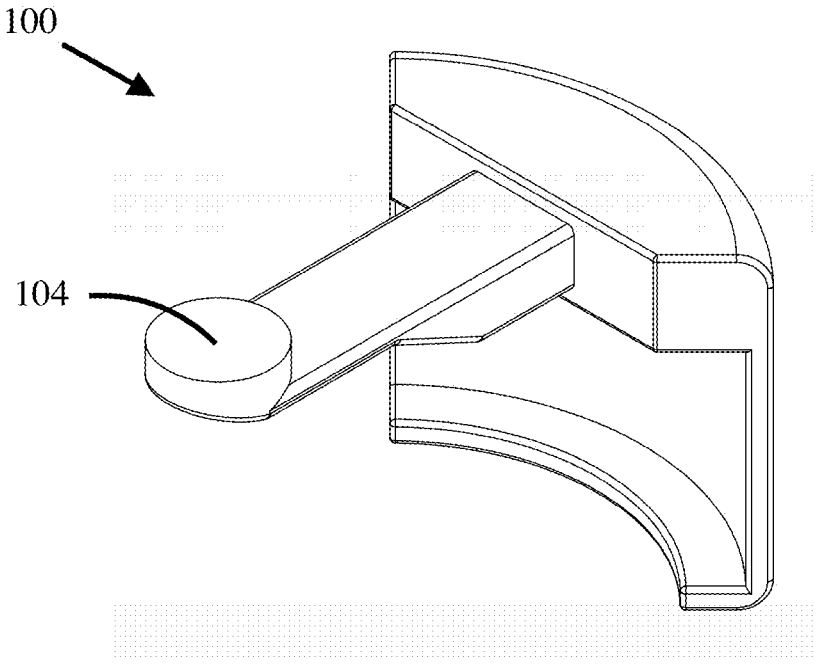
FIG. 25 is a top perspective view of a male part configured to engage the female part of FIG. 24.

Referring to FIGS. 24-25, the locking tab 104 and locking receiver 114 of the embodiment of FIGS. 20-23 can take various forms as desired such as the square configuration of FIGS. 20-23 or the round configuration of FIGS. 24-25.

Figure 26:
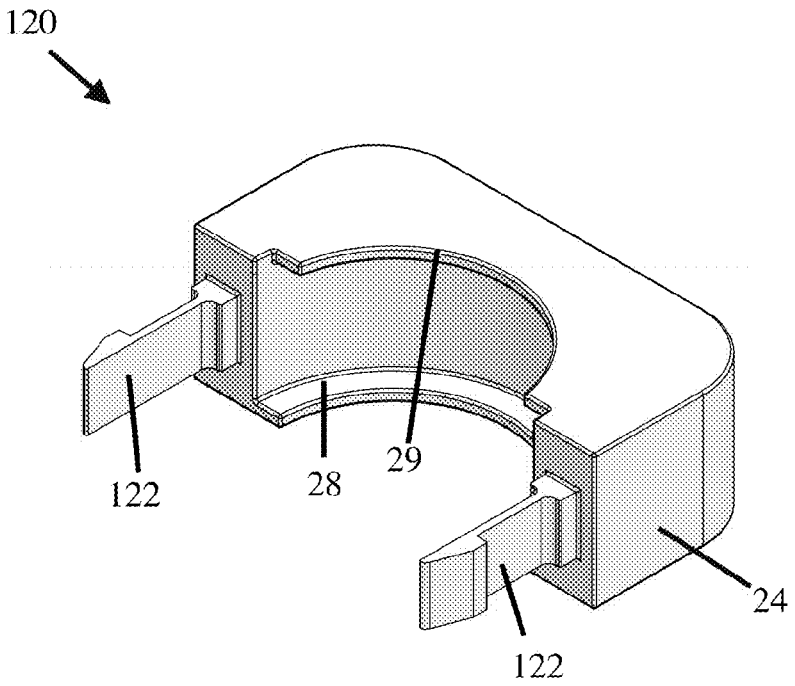
FIG. 26 is a top perspective view of a male part of a locking assembly according to another embodiment of the disclosure.
Figure 27:
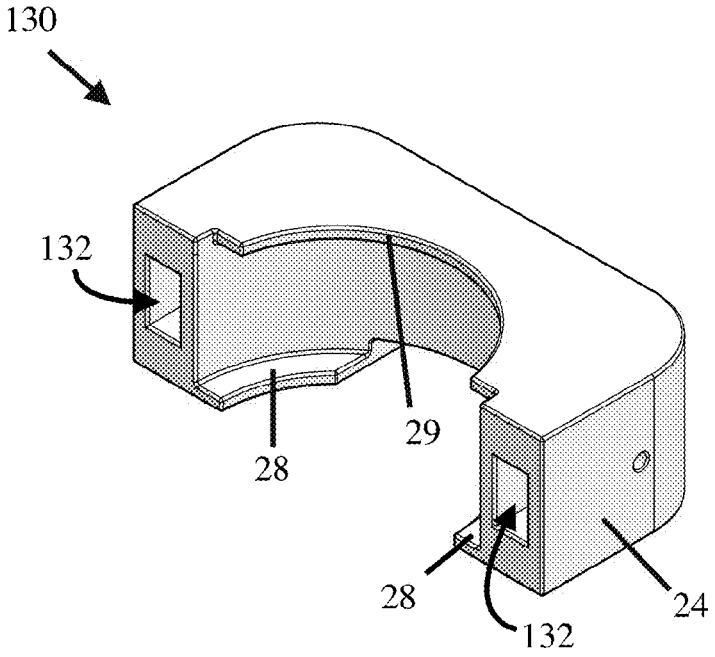
FIG. 27 is a top perspective view of a female part configured to receive the male part of FIG. 26.

According to alternate embodiments and referring to FIGS. 26-27, the vertical members 24 of a male part 120 and female part 130 are configured to be connected without requiring a horizontal member 22 to traverse the top surface 4 of the closure 2. For example, and as shown, the circumference of one or both of the vertical members 24 may be increased such that the sides of the vertical member 24 of the male part 120 are operable to be connected to the sides of the vertical member 24 of the female part 130 using engaging mechanisms 122, 132 such as those described above so that the two vertical members 24 form a ring/sheath around the sidewall 6 of the closure 2 in the locked position. In addition to hook elements 28 disposed at the distal end of the vertical members 24 of male part 120 and female part 130, the male 120 and female part 130 each include another hook element 29 disposed at the proximal end of their respective vertical member 24. While the hook elements 29 may take various forms, the hook elements 29 are preferably a lip or perforated tabs extending inward from the vertical member 24. Thus, according to this exemplary embodiment, the ring/sheath formed by connecting the sides of the vertical members 24 is operable to prevent the locking assembly from being lifted off a closure assembly via a first set of hook elements 28 disposed at the distal end of vertical members 24 and a second set of hook elements 29 disposed at the proximal end of vertical members 24. Similar to earlier embodiments, when the second vertical member is connected to the first vertical member and the locking assembly is installed on the closure system in a locked position, hook elements 28 are disposed beneath opposing sides of the sidewall of the closure such that the distal end of the hook elements 28 are disposed adjacent opposing sides of the sidewall of the container. Hook elements 29 are then disposed above at least a portion of opposing sides of the top surface 4 of the closure 2 to prevent the locking assembly from being removed from the closure assembly in the locked position.

Figure 28:
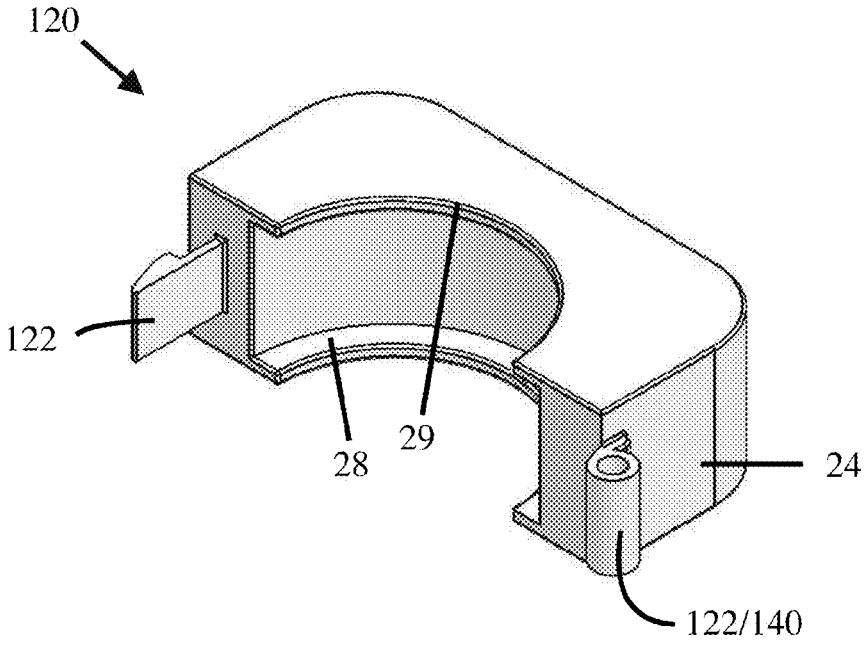
FIG. 28 is a top perspective view of a male part of a locking assembly according to another embodiment of the disclosure.
Figure 29:
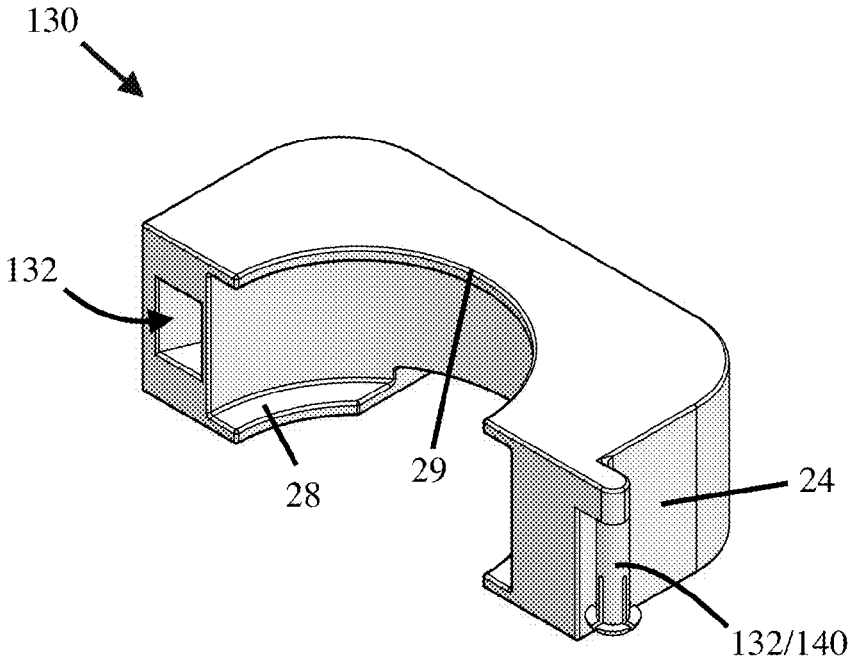
FIG. 29 is a top perspective view of a female part configured to receive the male part of FIG. 28.
Figure 30:
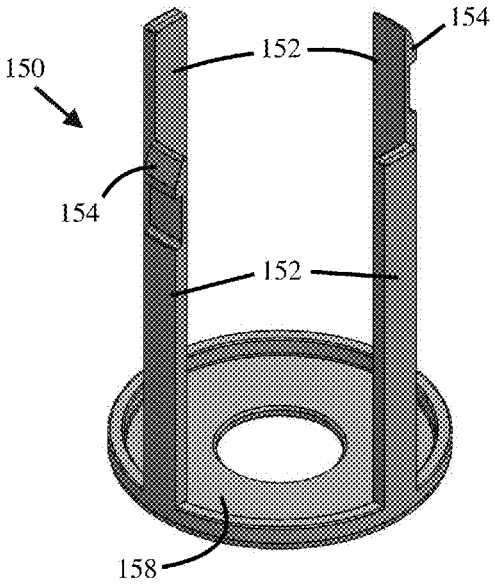
FIG. 30 is a perspective view of a male part of a locking assembly according to an another embodiment of the disclosure.
Figure 31:
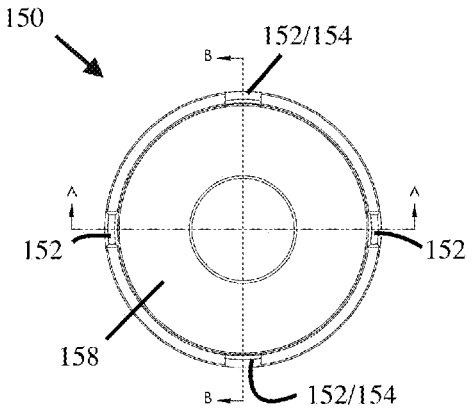
FIG. 31 is an overhead view of the male part of FIG. 30.
Figure 31A:
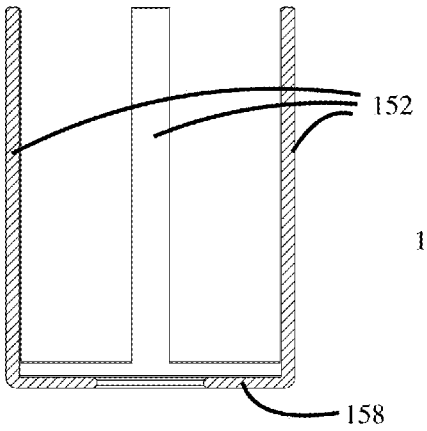
FIG. 31A is a cross-sectional view taken along plane A of FIG. 31.
Figure 31B:
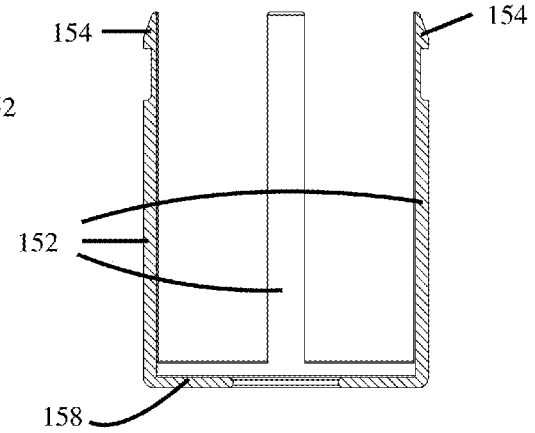
FIG. 31B is a cross-sectional view taken along plane B of FIG. 31.
Figure 32:
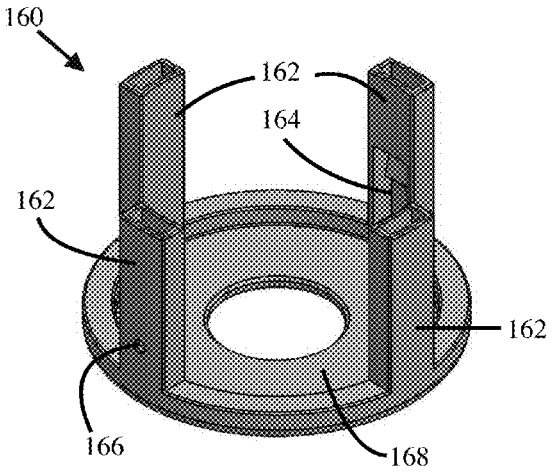
FIG. 32 is a perspective view of a female part configured to receive the male part of FIG. 30.
Figure 33:
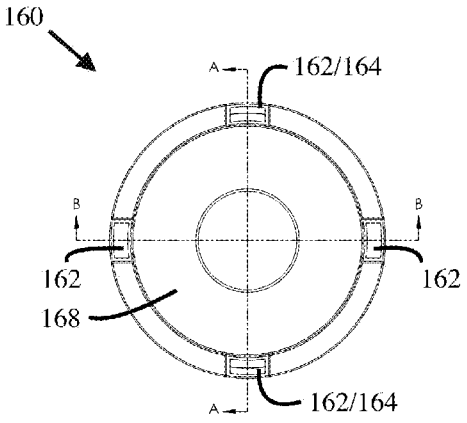
FIG. 33 is an overhead view of the female part of FIG. 32.
Figure 33A:
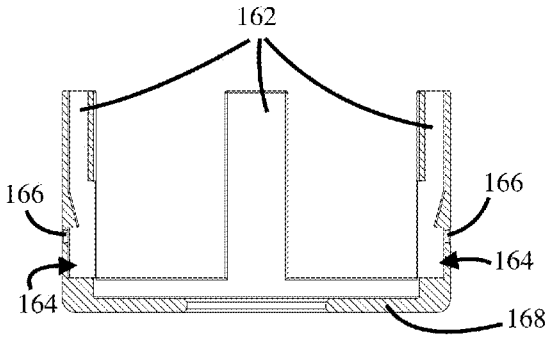
FIG. 33A is a cross-sectional view taken along plane A of FIG. 33.
Figure 33B:
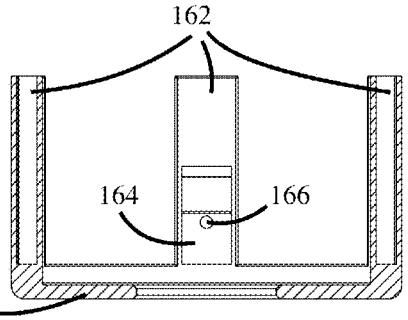
FIG. 33B is a cross-sectional view taken along plane B of FIG. 33.

Referring to FIGS. 28-29, another embodiment of the locking assembly of FIGS. 26-27 is shown except the engaging members of one side of the respective male and female parts include a hinge assembly 140 to allow the locking assembly to remain connected while moving between the locked and unlocked positions.

In view of the above, it should be understood that the critical components of locking assembly of FIGS. 2-29 are two opposing vertical members 24 having a first set of hook elements disposed adjacent a distal end of each vertical member and another set of hook elements disposed adjacent a proximal end of each vertical member. According to preferred embodiments and as shown in FIGS. 2-25, the second set of hook elements are operable to be connected to each other using corresponding male and female engaging members such that the second set of hook elements form a horizontal member that traverses the top surface of a closure in the locked position. However, in an alternate embodiment as depicted in FIGS. 26-29, the second set of hook elements may extend only partially over the top surface of the closure in the locked position.

According to yet another embodiment of the invention and referring to FIGS. 30-33, a locking assembly is provided that hooks to both the bottom of the container and the top of the closure to lock the locking assembly to a closure assembly. In other words, instead of having hook elements that are disposed underneath opposing sides of a closure as described above, the vertical members extend further down such that the hook elements are disposed beneath the bottom surface of the container. While many versions of this embodiment can be envisioned utilizing the concepts disclosed above with respect to other embodiments that hook underneath opposing sides of a closure, the embodiment shown in FIGS. 30-33 generally includes a male part 150 having a plurality of male engaging members 152 and a female part 160 having a plurality of corresponding female engaging members 162. Similar to the engaging mechanisms described, and particularly the embodiment of FIGS. 10-15, at least one of the male engaging members 152 (and preferably at least two of the male engaging members 152) includes a locking tab 154 operable to releasably engage a corresponding locking receiver 164 of the female engaging member 162. An aperture 166 is then disposed adjacent the locking receiver 164 such that a key protrusion is able to be inserted through the aperture 166 to deflect the locking tab 154 and disengage the locking tab 154 from the locking receiver 164 as described above. As shown, additional male and female engaging members 152, 162 may be provided without locking tabs 154 and locking receivers 164 if desired to provide additional support and make it more difficult to pry the engaging members 152, 162 away from the closure assembly in the locked position. As shown, the hooking elements of this embodiment are in the form of circular discs 158, 168, and the engaging members 152, 162 extend from their respective discs.

In preferred embodiments, the locking assembly is molded out of a stiff resin such as acrylonitrile butadiene styrene (ABS) to further prevent prying open of the device from a closure assembly when in the locked position, A slip additive such as siloxane may also be provided to allow for the male and female parts to easily slide between the locked and unlocked position.

The foregoing description of preferred embodiments for this disclosure has been presented for purposes of illustration and description. It is not intended to be exhaustive or to limit the disclosure to the precise form disclosed. In particular, and in view of the numerous potential embodiments of the locking assembly depicted and described herein, it should be understood that the male engaging member and corresponding female engaging member may take various forms within the scope of the present disclosure and obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A locking assembly comprising:

a closure system comprising:

a container having at least one of a rim extending from the sidewall of the container and a plurality of locking receivers extending from the sidewall of the container, and a closure for closing a container opening, a first vertical member configured to extend downward along a sidewall of a closure, the first vertical member including a first hook element disposed adjacent a proximal end of the first vertical member and a second hook element disposed adjacent a distal end of the first vertical member; and a second vertical member configured to be connected to the first vertical member such that the second vertical member extends downward along an opposite side of the sidewall of the closure from the first vertical member, the second vertical member including a first hook element disposed adjacent a proximal end of the second vertical member and a second hook element disposed adjacent a distal end of the second vertical member;

wherein, when the second vertical member is connected to the first vertical member in a locked position, the first and second vertical members extend along opposite sides of the sidewall of the closure without entirely covering the sidewall of the closure, the first and second vertical members are rigidly connected along a top surface of the closure so that the first hook elements of the first and second vertical members are disposed above opposing sides of a top surface of the closure, the second hook elements of the first and second vertical members are disposed beneath the rim or two or more of the locking receivers of the container, and a distal end of the second hook elements of the first and second vertical members are disposed adjacent opposing sides of a sidewall of a container.

2. The locking assembly of claim 1 wherein the first hook elements are connected to each other to form a horizontal member that traverses the top surface of the closure when the locking assembly is installed on the closure system in the locked position.

3. The locking assembly of claim 2 wherein the horizontal member is operable to move between an unlocked position and the locked position.

4. The locking assembly of claim 1 wherein the first hook element of the first vertical member forms a male engaging member and the first hook element of the second vertical member forms a female engaging member, the male engaging member operable to releasably engage the female engaging member to connect the second vertical member to the first vertical member and move the locking assembly between an unlocked position and the locked position.

5. The locking assembly of claim 4 wherein the male engaging member and the female engaging member form a horizontal member that traverses the top surface of the closure when the male engaging member is engaged with the female engaging member.

6. The locking assembly of claim 4 wherein the male engaging member includes a locking tab and the female engaging member includes a locking receiver, the locking tab operable to releasably engage the locking receiver to secure the male engaging member to the female engaging member in the locked position.

7. The locking assembly of claim 6 wherein the locking tab and locking receiver are dimensioned and configured so that a user can disengage the locking tab from the locking receiver by deforming the locking tab.

8. The locking assembly of claim 7 wherein the female engaging member includes a passage leading to the locking receiver, the male engaging member operable to slide within the passage of the female engaging member until the locking tab of the male engaging member engages the locking receiver of the female engaging member.

9. The locking assembly of claim 8 wherein the passage of the female engaging member includes an aperture disposed adjacent the locking receiver, the aperture dimensioned and configured to require a key to be inserted through the aperture to deform the locking tab so that a user can disengage the locking tab from the locking receiver.

10. The locking assembly of claim 9 wherein the key includes indicium warning the user to store the key in a location away from the locking assembly.

11. The locking assembly of claim 8 wherein the locking receiver is an aperture disposed in a top surface of the passage and the male engaging member and corresponding locking tab are dimensioned and configured such that the locking tab at least partially protrudes from the aperture in the locked position.

12. The locking assembly of claim 7 wherein the locking tab includes at least one deflectable wing and the female engaging member includes at least one depressible sidewall having a protrusion disposed on an interior surface of the depressible sidewall adjacent the locking receiver, the protrusion for deforming the at least one deflectable wing via the depressible sidewall so that a user can disengage the locking tab from the locking receiver.

13. The locking assembly of claim 7 wherein the female engaging member includes at least one depressible sidewall adjacent the locking receiver for deforming the locking tab so that the user can disengage the locking tab from the locking receiver.

14. The locking assembly of claim 1 further comprising a protrusion disposed on an interior surface of each of the first vertical member and the second vertical member, the protrusions configured to be inserted into corresponding indentions disposed in the sidewall of the closure to prevent axial movement of the closure when the locking assembly is installed on the closure assembly in the locked position.

15. A locking assembly comprising:

a male part including:

a male engaging member having a locking tab, a male vertical member extending downward from the male engaging member, and a first hook element disposed adjacent a distal end of the male vertical member; and a female part including:

a female engaging member having a locking receiver and a passage leading to the locking receiver, the male engaging member being dimensioned and configured to slide within the passage of the female engaging member until the locking tab engages the locking reciever in a locked position, the locking receiver having an aperture disposed adjacent the locking reciever and the locking tab and corresponding locking receiver being dimensioned and configured so that a user can disengage the locking tab from the locking receiver by deforming the locking tab through the aperture, a female vertical member extending downward from the female engaging member, and a second hook element disposed adjacent a distal end of the female vertical member, wherein, when the locking assembly is installed on a closure system in the locked position, the male and female engaging members form a horizontal member dimensioned and configured to traverse a top surface of a closure and the male and female vertical members are dimensioned and configured so that the first and second hook elements are disposed beneath opposing sides of a sidewall of the closure and a distal end of the first and second hook elements are disposed adjacent opposing sides of a sidewall of a container for preventing the closure from being removed from the container.

16. The locking assembly of claim 15 wherein the aperture is dimensioned and configured to require a key to be inserted through the aperture to deform the locking tab so that a user can disengage the locking tab from the locking receiver.

17. The locking assembly of claim 16 wherein the key includes indicium warning the user to store the key in a location away from the locking assembly.

18. The locking assembly of claim 15 wherein the male engaging member and corresponding locking tab are dimensioned and configured such that the locking tab at least partially protrudes from the aperture in the locked position.

19. A locking assembly comprising:

a closure system having a container and a closure for closing a container opening, the closure having a plurality of indentions disposed in a sidewall of the closure;

a horizontal member including a first end and a second end;

a first vertical member extending downward from the first end of the horizontal member, the first vertical member including a first protrusion disposed on an interior surface of the first vertical member; and a second vertical member extending downward from the second end of the horizontal member, the second vertical member including a second protrusion disposed on an interior surface of the second vertical member;

wherein, when the locking assembly is in a locked position, the horizontal member is dimensioned and configured to traverse a top surface of the closure and the first and second vertical members are dimensioned and configured so that each of the first and second protrusions are operable to be inserted into one of the plurality of indentions disposed in the sidewall of the closure for preventing axial movement of the closure.

20. The locking assembly of claim 19 wherein each of the first and second protrusions are dimensioned and configured to be disposed between two adjacent locking receivers of a container having a plurality of locking receivers extending from a sidewall of the container when the locking assembly is installed on the closure system in the locked position.

21. The locking assembly of claim 19 wherein the horizontal member is operable to expand between an unlocked position and the locked position.

22. The locking assembly of claim 19 further comprising a male part including the first vertical member and a male engaging member and a female part including the second vertical member and a female engaging member, the male engaging member operable to releasably engage the female engaging member to move the locking assembly between an unlocked position and the locked position.

23. The locking assembly of claim 22 wherein the male engaging member and the female engaging member form the horizontal member when the male engaging member is engaged with the female engaging member.

* * * * *